US005450186A

United States Patent [19]

Lundy

[11] Patent Number: 5,450,186

[45] Date of Patent: Sep. 12, 1995

[54] RETRACTABLE FLEXIBLE CLEANER BRUSH

[76] Inventor: Douglas A. Lundy, 887 DeWitt Rd., Webster, N.Y. 14580

[21] Appl. No.: 262,129

[22] Filed: Jun. 17, 1994

[51] Int. Cl.[6] ..... G03G 21/00

[52] U.S. Cl. ..... 355/301; 15/256.5

[58] Field of Search ..... 355/296, 300, 301; 118/652; 15/1.51, 256.5, 256.51, 256.52, 256.53

[56] References Cited

U.S. PATENT DOCUMENTS

| | | | |
|---|---|---|---|
| 3,776,632 | 12/1973 | Smith et al. | 355/300 X |
| 3,819,263 | 6/1974 | Draugelis et al. | 355/215 |
| 3,879,785 | 4/1975 | Roth et al. | 355/300 X |
| 4,001,910 | 1/1977 | Pellet | 15/184 |
| 4,449,241 | 5/1984 | Nakayama | 15/256.52 X |
| 4,551,217 | 11/1985 | King | 204/212 |
| 4,567,905 | 2/1986 | Stewart et al. | 132/40 |
| 5,083,169 | 1/1992 | Usui et al. | 355/296 |

*Primary Examiner*—William J. Royer
*Attorney, Agent, or Firm*—T. L. Fair

[57] ABSTRACT

A flexible cleaner brush belt increases brush belt life by flexing away from the photoreceptor when not in use. The flexible belt is lifted away from contact with the photoreceptor and placed back into contact with the photoreceptor by a camming device. A camming device attached to linkages, increase the diameter of the flexible brush belt to lift the brush belt away from contact with the imaging surface. The camming device urges the belt brush back into contact with the imaging surface by decreasing the diameter of the brush belt. This movement of the brush belt increases the brush belt life and does not cause print quality defects, excessive toner clouding, or loss of machine productivity.

13 Claims, 4 Drawing Sheets

RETRACTABLE FLEXIBLE CLEANER BRUSH

This application is related to the commonly-assigned U.S. Pat. No. 5,381,218 entitled "Conductive Cleaning Brush Belt and Detoning Thereof" to Douglas A. Lundy.

BACKGROUND OF THE INVENTION

This invention relates generally to an electrostatographic printer or copier, and more particularly concerns a flexible belt cleaning apparatus used therein.

In an electrophotographic application such as xerography, a charge retentive surface (i.e., photoconductor, photoreceptor or imaging surface) is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (eg., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charge surface maybe imagewise discharged in a variety of ways. Ion projection devices where a charge is imagewise deposited on a charge retentive substrate operates similarly.

Although a preponderance of the toner forming the image is transferred to the paper during transfer, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom.

A commercially successful mode of cleaning employed on automatic xerographic devices utilizes a brush with soft conductive fiber bristles or with insulative soft bristles which have suitable triboelectric characteristics. While the bristles are soft for the insulative brush, they provide sufficient mechanical force to dislodge residual toner particles from the charge retentive surface. In the case of the conductive brush, the brush is usually electrically biased to provide an electrostatic force for toner detachment from the charge retentive surface. The fixed radius of commonly used brushes can limit it's cleaning applications. Also, maintaining the fibers of the cleaning brush in constant contact with the imaging surface accelerates set of the brush at the cleaning nip.

The following disclosures may be relevant to various aspects of the present invention and may be briefly summarized as follows:

U.S. Pat. No. 4,567,905 to Stewart et al. discloses a slideable control for use in retractable bristle brushes. The control operates by co-action with a rotatable cylindrical mandrel carrying pivoted bristles and having an angular cam slot. The control includes a longitudinally slideable button in the handle which has a control.

U.S. Pat. No. 4,551,217 to King discloses two electrodes of an apparatus are concentrically disposed one within the other and two sets of scrubbing brushes are utilized, one mounted on the stationary electrode for cleaning the inner, rotary electrode and the other mounted on the rotary electrode itself for cleaning the stationary electrode during such rotation. A cam arrangement momentarily retracts one of the brushes out of the path of travel of the other during each revolution to avoid having the two brushes strike one another.

U.S. Pat. No. 4,001,910 to Pellet discloses retractable brushes, of the general type having bristles which can be retracted into the casing of the brush, or moved outwardly from the casing into the position at which the bristles are used.

U.S. Pat. No. 3,819,263 to Draugelis et al. discloses rotating a housing from its non-operative position wherein the brush is spaced approximately one inch from a transfer roll to its operative position wherein the brush contacts the surface of transfer roll to dislodge residual toner particles remaining thereon.

SUMMARY OF INVENTION

Briefly stated, and in accordance with one aspect of the present invention, there is provided an apparatus for cleaning particles from a surface. The apparatus comprises a flexible brush including a flexible member and a multiplicity of fibers extending outwardly therefrom. Means for stretching the flexible brush to move the fibers of the flexible brush between an operative position in contact with the surface for removal of particles therefrom, and a non-operative position spaced from the surface.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 4:
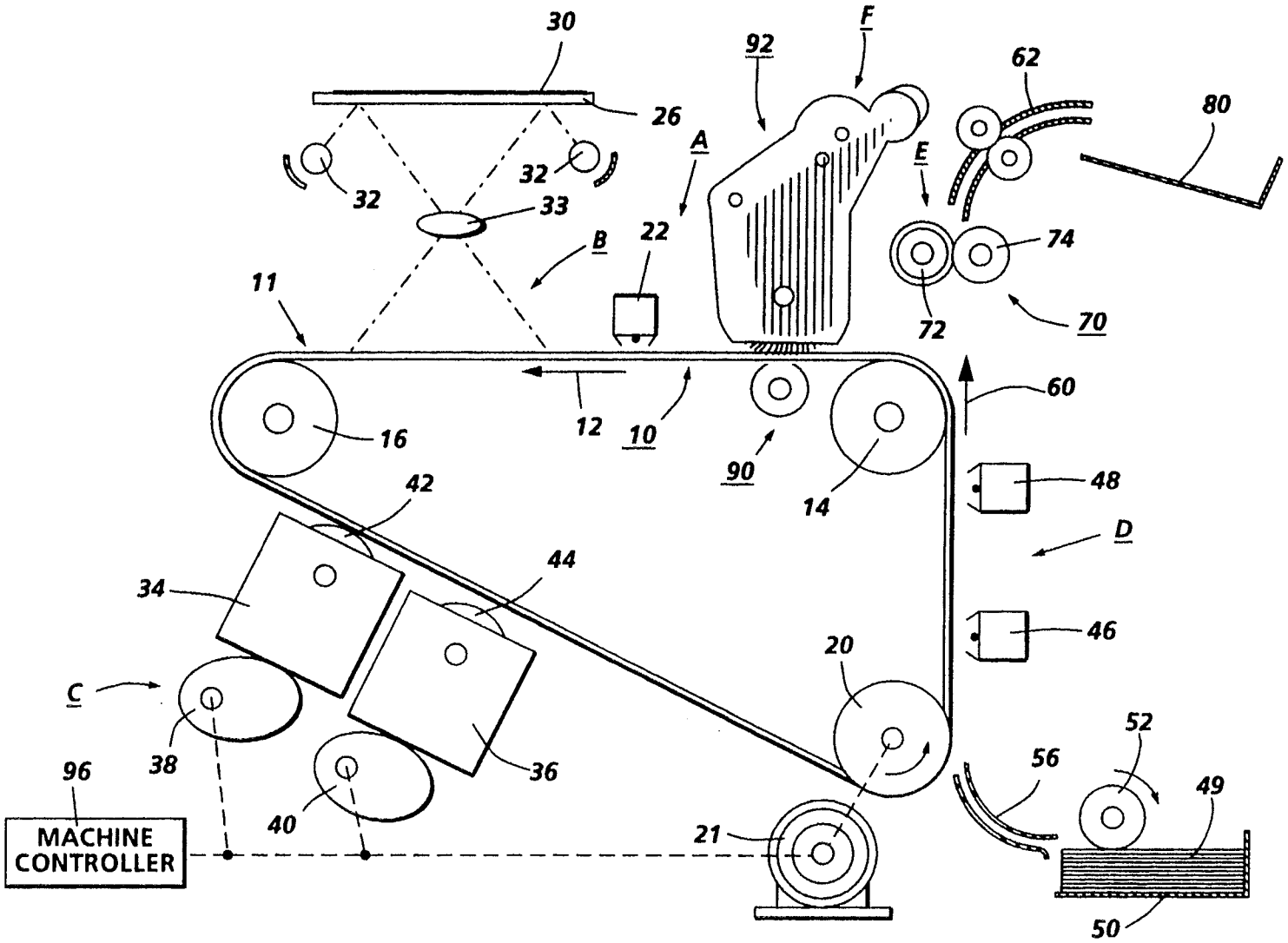
FIG. 4 is a schematic illustration of a printing apparatus incorporating the inventive features of the present invention.

For a general understanding of an electrophotographic printer or copier in which the present invention may be incorporated, reference is made to FIG. 4, which depicts schematically the various components, thereof. Hereinafter, like reference numerals will be employed throughout to designate identical elements.

Although the disengaging and engaging flexible cleaner brush apparatus of the present invention is particularly well adapted for use in an electrophotographic printing machine, it should become evident from the following discussion, that it is equally well suited for use in other applications and is not necessarily limited to the particular embodiment shown herein.

Referring now to the drawings, the various processing stations employed in the reproduction machine illustrated in FIG. 4, will be described briefly hereinafter. It will no doubt be appreciated that the various processing elements also find advantageous use in electrophotographic printing applications from an electronically stored original, and with appropriate modifications, to an ion which deposits ions and image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance successive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 4, initially a portion of the belt 10 passes through charging station A. At charging station A, a corona device 22 charges a portion of the photoreceptor belt 10 to a relatively high, substantially uniform potential, either positive or negative.

At exposure station B, an original document 30 is positioned face down on a transparent platen 26 for illumination with flash lamps 32. Light rays reflected from the original document are reflected through a lens 33 and projected onto the charged portion of the photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, the belt 10 advances the electrostatic latent image to development station C. At development station C, either developer housing 34 or 36 is brought into contact with the belt 10 for the purpose of developing the electrostatic latent image. Housings 34 and 36 may be moved into and out of developing position with corresponding cams 38 and 4(3, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, the corona generator 48 charges the copy sheet to an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50, with sheet feeder 52, and advanced to transfer station D along conveyor 56.

After transfer, the sheet continues to move in the direction of arrow 60 to fusing station E. Fusing station E includes a fuser assembly indicated generally by the reference numeral 70, which permanently affixes the transfer toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the photoreceptor belt 10 after each copy is made, may be removed at cleaning station F. The cleaning apparatus of the present invention is represented by the reference numeral 92 which will be described in greater detail in FIGS. 1 and 2. Removed residual particles may also be stored for disposal. A backup roll 90 is provided as support to the photoreceptor belt 10 during the cleaning phase of the xerographic process.

A machine controller 96 is preferably a known programmable controller or combination of controllers, which conventionally control all the machine steps and functions described above. The controller 96 is responsive to a variety of sensing devices to enhance control of the machine, and also provides connection diagnostic operations to a user interface (not shown) where required.

Figure 1:
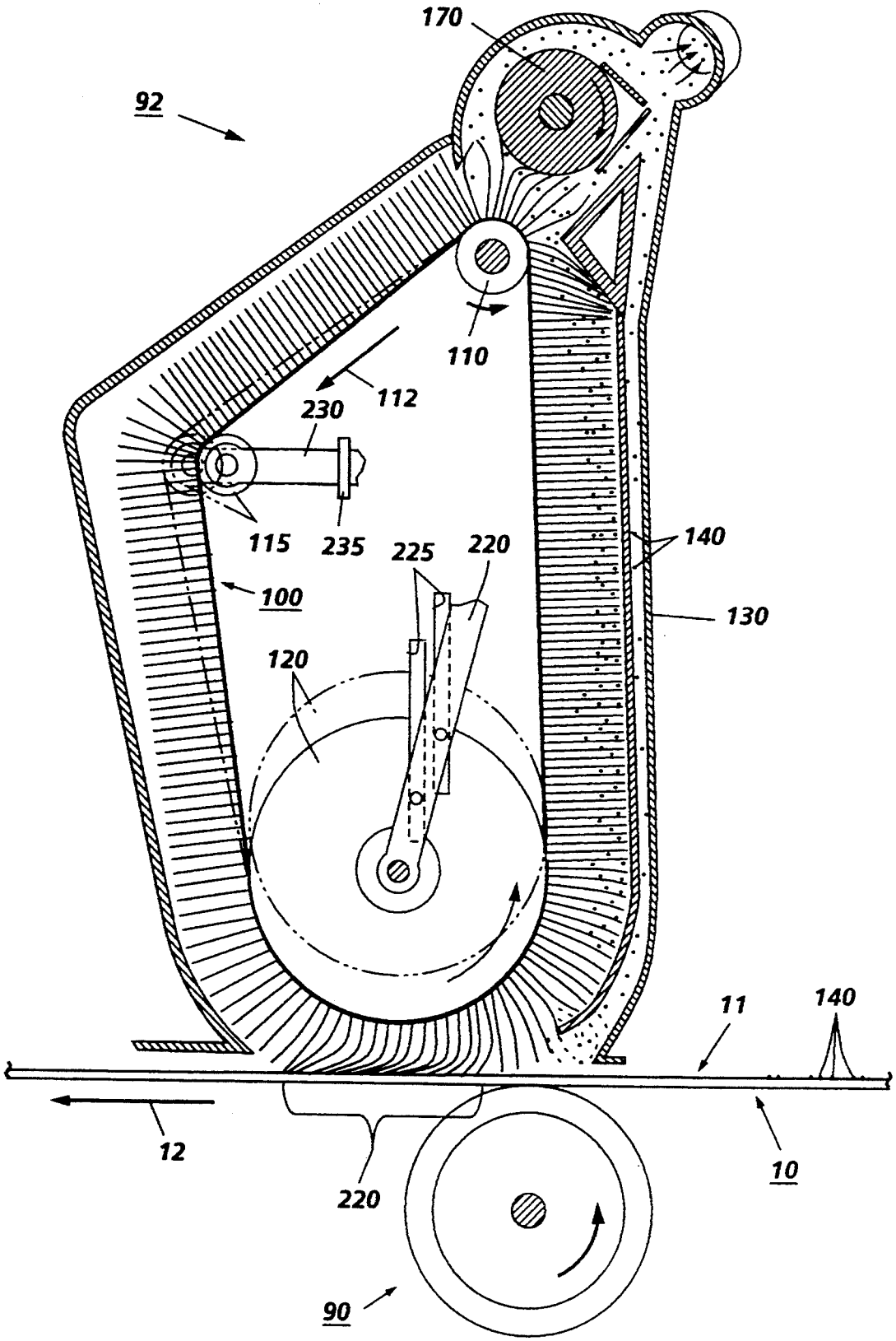
FIG. 1 is an elevational view of the present invention.
Figure 2:
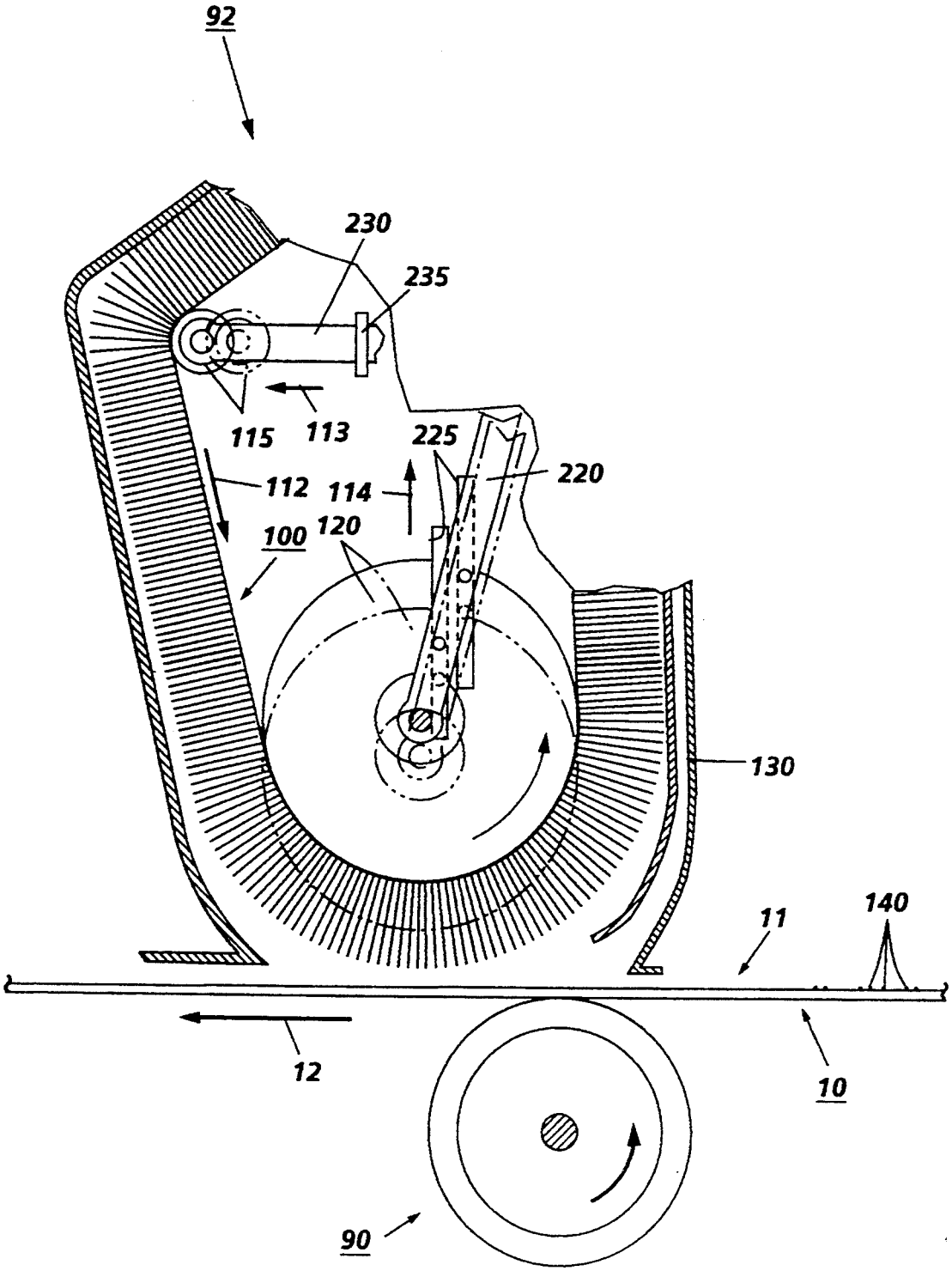
FIG. 2 is a partial elevational view of of the present invention with the brush fibers out of contact with the imaging surface of the photoreceptor.
Figure 3:
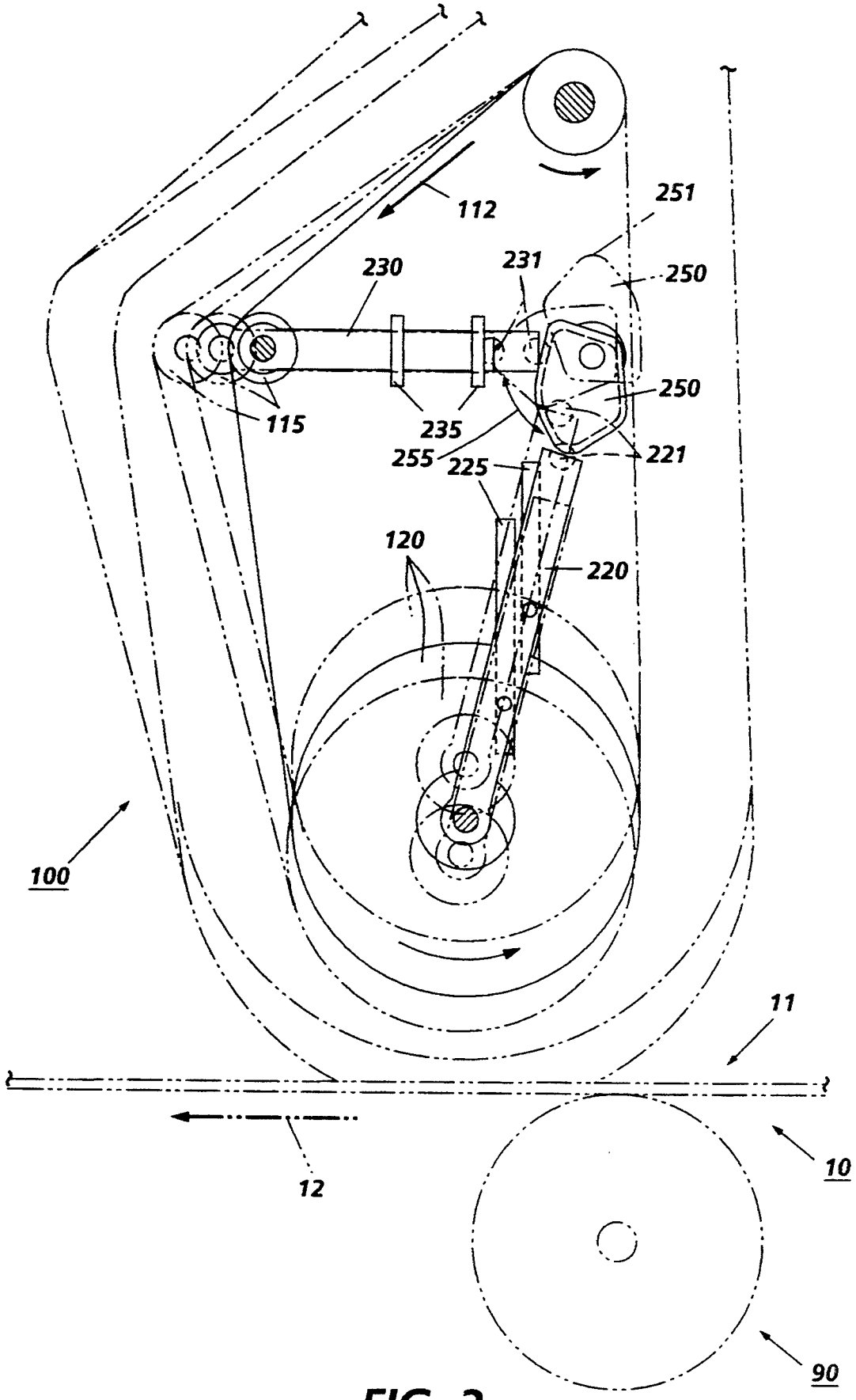
FIG. 3 is a schematic of the present invention showing the mechanical device for engaging and retracting the brush belt from the the imaging surface of the photoreceptor.

As thus described, a reproduction machine, in accordance with the present invention may be any of several well known devices. Variations may be expected in specific electrophotographic processing, paper handling and control arrangements without effecting the present invention. However, it is believed that the foregoing description is sufficient for purposes of the present application to illustrate the general operation of an electrophotographic printing machine which exemplifies one type of apparatus employing the present invention therein. Reference is now made to FIGS. 1 through 3 where the showings are for the purpose of illustrating preferred embodiments of the present invention and not for limiting the same.

Reference is now made to FIG. 1, which shows an elevational view of the preferred embodiment of the present invention. The flexible brush belt 100 is shown in a vertical configuration for removing toner and other particles 140 from the photoreceptor. The cleaning system has a flexible belt brush 100 that is comprised of a continuous loop of conductive backing material (e.g. urethane or Mylar) to which conductive brush fibers are attached. The cleaning nip 220 of the belt brush is that area of the brush in contact with the photoreceptor surface 11.

The present invention provides an efficiently retracting flexible cleaning brush belt 100 from the surface 11 of the photoreceptor 10. The brush belt 100 is supported by at least three rollers providing primary functions. One roller 110 is in a fixed position and maintains the interference between the brush belt 100 and the detoning element 170. This roller 110 is also the drive roller that rotates the brush belt 100 in the direction indicated by the arrow 112. The other two rollers, one an idler roller 115 and the other roller 120 regulates the position of the belt 100 at the photoconductor 10, are connected to a linkage and cam assembly. The linkage and cam assembly would move the rollers 110, 115, 120 such that the belt perimeter around all of the rollers would remain constant.

Reference is now made to FIG. 2, which shows a partial elevational view of the present invention with the brush belt fibers out of contact with the imaging surface of the photoreceptor 10. The present invention includes an electromechanical apparatus to "flex" the cleaning belt in a manner as to lift the cleaning nip from contact with the imaging surface 11 when the printing machine is not in use. The lifting action occurs as nip roller 120 is moved in the direct ion shown by arrow 114 by the rod or linkage 220. Simultaneously the rod or linkage 230 moves in an outward direction shown by 113 pushing the idler roller 115 outward toward the elbow shape in the housing 130. When the flexible brush 100 is returned to contact with the photoreceptor 10, the nip roller 120 and the idler roller 115 move in opposite directions then those shown by arrows 114 and 113, respectively. The elbow shape of the housing 130 accommodates the outward movement of the idler roller 115.

Reference is now made to FIG. 3, which shows a schematic view of an electromechanical apparatus used to flex the cleaning belt 100 between positions in contact with the photoreceptor 10 and out of contact with the photoreceptor 10. This apparatus has a rotating cam 250, connected to two rods or linkages 220, 230. One rod 220 is connected to the idler roller 115, and the other rod 230 is connected to the nip roller 120 that creates the footprint of the brush belt 100 on the imaging surface of the photoreceptor 10. The cam 250 has the capability to rotate back and forth over a 180° range shown by the arrow 255. When retraction of the cleaning brush belt 100 from the photoreceptor 10 is desired, the electromechanical apparatus stretches the brush belt 100 apart to lift the cleaning fibers off the surface of the photoreceptor 10. This stretching of the brush belt 100 occurs when the actuated rotating cam 250 pushes the side or idler roller 115 outward, to expand the brush belt 100, with an opposing force to overcome the loading force of the nip roller 120 (i.e which moves the nip roller inward lifting the fibers from the surface). The movement of the nip roller 120 is guided by the pin guides 225. These pin guides 225 control the movement of the rod 220 attached to the cleaner nip roller 120 as it moves in concert with the cam 250 and the other rod 230 to retract the belt brush 100 from the photoreceptor 10. (The pin guides 225 also work in concert with the cam 250 and the other rod to place the brush belt 100 back into contact with the surface.) Likewise, the movement of the linkage 230 is controlled by the brackets 235 and a guide bar which act as a guide for the horizontal movement of the rod 230. The brackets 235 prevent the occurrence of binding between the guide bar and the cam assembly. This retraction and engagement motion of the flexible belt is desirable feature especially during a process control setup or during multiple color passes. (For color machines, where the image is layed down on another image before transfer, no cleaning of the photoreceptor 10 can take place. For other machines, it may be desirable to lift the brush after process patches have been put down to setup the process controls.)

With continued reference to FIG. 3, when engagement of the cleaning brush belt 100 is desired, the actuated cam 250 rotates an additional 180°, moving the linkages, causing the idler roll 115 to move inward and the cleaning nip roller 120 to move outward, engaging the belt fibers to the photoreceptor 10. The advantage of this flexing brush is that it does not rest against the photoreceptor 10 when the machine is not in operation. The pile fabric of the brush belt 100 can be conductive or insulative (if insulative, the backing can be non-conductive). The ends of each of the rods 220, 230 have detents 221,231 that follow a track around the perimeter of the surface of the cam 250. The highest point of contact between the cam 250 and the rods, 220, 230 occurs when the apex 251 of the cam 250 is in contact with the end of the rod 230 and the flat of the cam 250 is in contact with the top of rod 220.

To engage the flexible brush 100 into contact with the surface and to retract the flexible brush 100 from the surface, the cam 250 rotates between the 6 o'clock and 9 o'clock position (i.e. approximately 45°). The cam 250 has a track along the perimeter of it's surface that the detents 221, 231 on the ends of the rods 220 and 230 respectively, follow. At approximately the 6 o'clock position, the apex 251 of the cam 250 is in contact with the end of the rod 220 opposite the end that is attached to the nip roller 120. At this position, the cam 250 moves the nip roller 120 outward into contact with the surface of the photoreceptor 10. One of the flat sides of the cam is in contact with the opposite end of the rod 230 in contact with the idler roller 115, which moves the idler roller 115 inward. As the cam 250 rotates toward the 9 o'clock position, the apex 251 of the cam 250, moves into contact with the end of the rod 230, opposite the idler roller 115. At this position, the apex 251 of the cam 250 moves from the end of rod 220 to the end of rod 230 which moves the idler roller outward and the nip roller inward away from the surface, lifting the flexible belt from the surface. Removing the flexible brush from the surface when the machine is not in operation extends the life of the brush belt 100 because it reduces the opportunity for set of the fibers to take place. This mechanical apparatus also enables resetting of the contact cleaning nip of the cleaning fibers without causing print quality defects, excessive toner clouding, or loss of machine productivity.

With continued reference to FIG. 3, rotation of the apex 251 of the cam 250 past the 9 o'clock position, and up to the 12 o'clock position, enables replacement of the brush belt 100. As the apex 251 of the cam 250 rotates past the 9 o'clock position, the brush belt 100 is no longer in tension. The slackness of the brush belt 100 allows the belt to be easily removed and replaced. When a new brush belt is put in place, the cam is rotated back to a position between and including 6 o'clock to 9 o'clock position to once again provide tension to hold the belt 100 in place about the rollers.

Another feature of the present invention is that the cam 250 allows the setting of more than one position for flexing. This allows the brush belt 100 to be placed in closer contact with the surface when set has begun to take place in the brush belt 100, so that the set fibers of the flexible brush 100 are still capable of cleaning the photoreceptor 10. This increases the life of the brush belt 100 by bringing the brush and the photoreceptor 10 into close cleaning contact for continued cleaning of the photoreceptor 10 even after set has begun in the brush fibers. This can be handled by the technical representative or a knob situated such that the customer can be instructed by the technical representative how much adjustment is required for alleviation of copy defects.

In recapitulation, the present invention provides a flexible belt brush to clean an imaging surface. The flexible belt is lifted from contact with the photoreceptor and placed back in contact with the photoreceptor by a camming device. By increasing the diameter of the brush belt with a camming device, the brush belt is lifted from contact with the imaging surface. By decreasing the diameter of the brush belt with the camming device, the brush belt is placed back into contact with the photoreceptor. This movement of the brush belt does not cause print quality defects, excessive toner clouding, or loss of machine productivity.

It is, therefore, apparent that there has been provided in accordance with the present invention, a conductive flexible belt brush that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for cleaning particles from a surface, comprising:

a flexible brush including a flexible member, and a multiplicity of fibers extending outwardly from the flexible member; and means for stretching said flexible brush to move the fibers of said flexible brush between an operative position in contact with the surface for removal of particles therefrom and a non-operative position spaced from the surface.

2. An apparatus as recited in claim 1, further comprising a detoning device to remove the particles from said brush to ensure sufficient cleaning of said brush.

3. An apparatus as recited in claim 1, wherein said stretching means comprises:

a camming device; and a multibar linkage associated with said camming device.

4. An apparatus as recited in claim 3, further comprising at least two rollers associated with said multibar linkage for supporting said flexible brush.

5. An apparatus as recited in claim 4, wherein the flexible member of said flexible brush comprises an endless belt enclosing said linkage therein.

6. An apparatus as recited in claim 5, wherein said multibar linkage moves between a first position that stretches the flexible brush outward by urging a first one of said rollers into contact with an inner surface of the belt of said brush, and a second position that moves a second one of said rollers out of contact with the inner surface of the belt of said brush.

7. An apparatus as recited in claim 6, wherein:

said rollers include an idler roller and a nip roller, and said multibar linkage includes a first linkage having one end coupled to said idler roll and a second linkage having one end coupled to said nip roller.

8. An apparatus as recited in claim 7, further comprising a housing defining an open ended chamber, said housing having an interior wall with said brush being mounted in the chamber and fibers extending outwardly from the open end in the operative position.

9. An apparatus as recited in claim 8, wherein said camming device is rotatable, to move said flexible brush between multiple positions.

10. An apparatus as recited in claim 9, wherein said camming device comprises:

an apex; and a pair of flat surfaces adjacent to said apex.

11. An apparatus as recited in claim 10, wherein said apex being rotated into contact with the one end of said first linkage and one of said flat surfaces being rotated into contact with the one end of said second linkage, causing said first linkage to stretch said flexible brush outward toward the interior wall of said housing and said second linkage enabling movement of said flexible brush away from the surface to the nonoperative position.

12. An apparatus as recited in claim 11, wherein said apex being rotated into contact with the one end of said second linkage and another one of said flat surfaces being rotated into contact with the one end of said first linkage, causing said second linkage to stretch said flexible brush outward moving said fibers of said flexible brush into the operative position being spaced from said housing.

13. An apparatus as recited in claim 12, wherein said apex is rotated to a position spaced from said first linkage and said second linkage, with one of said flat surfaces being rotated into contact with the one end of said first linkage and another of said flat surfaces being in contact with the other end of said second linkage enabling said flexible brush to become slack for removal from said rollers.

* * * * *